US010591241B2

(12) United States Patent
Schneider

(10) Patent No.: US 10,591,241 B2
(45) Date of Patent: Mar. 17, 2020

(54) MODULAR WEAPON HAVING A STRIKING MECHANISM FOR TRIGGERING A FIRING PIN

(71) Applicant: RHEINMETALL WAFFE MUNITION GMBH, Unterluess (DE)

(72) Inventor: Hubert Schneider, Dietingen (DE)

(73) Assignee: Rheinmetall Waffe Munition GmbH, Unterleuss (DE)

( * ) Notice: Subject to any disclaimer, the term of this patent is extended or adjusted under 35 U.S.C. 154(b) by 0 days.

(21) Appl. No.: 15/867,545

(22) Filed: Jan. 10, 2018

(65) Prior Publication Data

US 2018/0231344 A1 Aug. 16, 2018

Related U.S. Application Data

(63) Continuation of application No. PCT/EP2016/065873, filed on Jul. 5, 2016.

(30) Foreign Application Priority Data

Jul. 10, 2015 (DE) ..... 10 2015 008 795
Dec. 14, 2015 (DE) ..... 10 2015 121 771

(51) Int. Cl.

| | |
|---|---|
| ***F41A 3/00*** | (2006.01) |
| ***F41A 25/26*** | (2006.01) |
| ***F41A 3/44*** | (2006.01) |
| ***F41A 11/02*** | (2006.01) |
| ***F41A 17/30*** | (2006.01) |

(Continued)

(52) U.S. Cl.

CPC ..... *F41A 25/26* (2013.01); *F41A 3/44* (2013.01); *F41A 7/08* (2013.01); *F41A 11/02* (2013.01); *F41A 17/30* (2013.01); *F41A 17/58* (2013.01); *F41A 17/76* (2013.01); *F41A 19/18* (2013.01); *F41A 19/47* (2013.01); *F41A 21/06* (2013.01); *F41A 25/12* (2013.01); *F41A 25/22* (2013.01); *F41F 1/08* (2013.01); *F41A 7/00* (2013.01)

(58) Field of Classification Search

CPC ..... F41A 3/00; F41A 7/08; F41A 7/04; F41A 17/18; F41A 19/47; F41A 9/33

USPC ..... 89/11, 17, 28.05, 24, 1.4; 42/69.03; 428/182, 212

See application file for complete search history.

(56) References Cited

U.S. PATENT DOCUMENTS 2,590,153 A * 3/1952 Bunnell ..... F41A 7/04 89/1.4
3,656,249 A * 4/1972 Raville ..... F41A 17/26 42/69.03

(Continued)

FOREIGN PATENT DOCUMENTS

DE 10 2006 004 954 A1 8/2007
DE 10 2008 060 214 A1 6/2010

(Continued)

*Primary Examiner* — Michael D David

(74) *Attorney, Agent, or Firm* — Muncy, Geissler, Olds & Lowe, P.C.

(57) ABSTRACT

A weapon which has a modular design. The weapon is subdivided into weapon-specific modular assemblies which are designed as carrier units of the components. The modular assemblies include a weapon housing into which a breech system of the weapon and a striking mechanism is provided, a weapon cradle that connects with the weapon housing, and a weapon barrel module. The modular assemblies are connected to each other by rails and guides, by binders and holders, by pins, or by bolts and quick release fasteners.

13 Claims, 16 Drawing Sheets

(51) Int. Cl.

| | |
|---|---|
| ***F41A 17/58*** | (2006.01) |
| ***F41A 17/76*** | (2006.01) |
| ***F41A 19/18*** | (2006.01) |
| ***F41A 19/47*** | (2006.01) |
| ***F41A 21/06*** | (2006.01) |
| ***F41A 25/12*** | (2006.01) |
| ***F41A 25/22*** | (2006.01) |
| ***F41F 1/08*** | (2006.01) |
| ***F41A 7/08*** | (2006.01) |
| *F41A 7/00* | (2006.01) |

(56) References Cited

U.S. PATENT DOCUMENTS

| | | | | |
|---|---|---|---|---|
| 5,317,949 | A * | 6/1994 | Sugg | F41A 19/47 89/24 |
| 6,176,169 | B1 * | 1/2001 | Rostocil | B64D 7/00 42/25 |
| 7,820,271 | B2 * | 10/2010 | Rasmussen | B32B 3/28 428/182 |
| 8,479,633 | B2 * | 7/2013 | Herrmann | F41A 7/08 89/17 |

FOREIGN PATENT DOCUMENTS

| | | | |
|---|---|---|---|
| DE | 10 2009 011 939 | A1 | 9/2010 |
| DE | 20 2009 007 415 | U1 | 9/2010 |
| DE | 20 2011 103 707 | U1 | 1/2012 |
| DE | 20 2012 004 430 | U1 | 8/2012 |
| DE | 10 2014 108 469 | A1 | 12/2015 |
| WO | WO 80/02067 | A1 | 10/1980 |
| WO | WO 2010/102727 | A1 | 9/2010 |

* cited by examiner 33
33.3
33.3
33.2
33.2
33.1
33.1

2.6.1
2.6

2.4
3.3
2.2
2.5
2.3
2.6
2.5
3.5
3.3
2.5
3.5
3.3
3.5
2.2.1
3.6
2.2.1
3.5
33

MODULAR WEAPON HAVING A STRIKING MECHANISM FOR TRIGGERING A FIRING PIN

This nonprovisional application is a continuation of International Application No. PCT/EP2016/065873, which was filed on Jul. 5, 2016, and which claims priority to German Patent Application No. 10 2015 008 795.9, which was filed on Jul. 10, 2015 and German Patent Application No. 10 2015 121 771.6, which was filed on Dec. 14, 2015, and which are both herein incorporated by reference.

BACKGROUND OF THE INVENTION

Field of the Invention

The present invention relates to a weapon which is of a modular and compact construction, in particular an externally powered weapon but also a self-powered weapon, and which can be mounted on a carriage. At the same time, the weapon is designed such that assembly and disassembly of the weapon can be performed without any tools. The weapon dispenses with screw connections, etc. The individual components of the weapon are supplemented by adding individual parts and mechanically linked or connected to one another. The modular character of the individual components is in this case retained in spite of the added individual parts (assemblies associated with the functions of the main assemblies). The fastening of the individual parts to the modules or of the modules to one another is primarily performed by means of systems of rails and guides. These are incorporated on the one hand on the individual parts and on the other hand in/on the modules and are made to match one another (complementary). Further fastener on or within the weapon or the components are bolts, pins, locking mechanisms, holding-down devices and the like. A module is understood as meaning a self-contained functional unit or assembly.

Description of the Background Art

DE 20 2011 103 707 U1 describes a modular weapon carrier system. In it, a four-legged weapon platform that can be vertically moved hydraulically and has at least three joints for each standing leg is disclosed. A modular weapon platform or a modular weapon carrier can be taken from DE 20 2009 007 415 U1. DE 10 2006 004 954 A1 discloses a self-defense launching device. DE 20 2012 004 430 U1 likewise shows a modular launching device. A modular launcher in DE 20 2010 008 821 U1 is distinguished by the fact that the magazines of the laucher are mounted on a base plate by screwing etc. and the modular electronics unit can be pivoted up to the end of the magazines for making electrical contact with the base unit.

U.S. Pat. No. 7,820,271 B2 shows a hand gun that can be assembled from individual modules. Assembly is performed by means of hooks and lugs and guides corresponding thereto in the complementary modules.

WO 2010/102727 A1 discloses a hybrid weapon that can be integrated in a carriage. In the hand-held version, the weapon is self-powered, in the integrated version it is powered by means of an external drive. The weapon has a main weapon body, which receives a weapon barrel, a falling-block breech action and a locking slide. Also integrated in the main body are a firing pin release and the assemblies of the weapon's own drive. The breech system of the weapon is connected to its own drive or by way of a bolt to the external drive. The weapon's own drive is then locked.

DE 10 2008 060 214 A1, which corresponds to U.S. Pat. No. 8,479,633, discloses a breech drive for a weapon with a linear breech feed. The breech drive is formed by a crank drive, which converts a rotational movement into a linear forward and backward movement.

DE 10 2009 011 939 A1 concerns a locking device for a simple breech system, in particular for an externally powered or self-powered weapon. Here, the breech or breech carrier is engaged under and therefore locked by a wedge-like block that can be displaced vertically in relation to the breech, so that a positively locking connection is produced. Vertically is considered here to mean all directions that are technically possible in the weapon, such as vertically from below, vertically from the side of vertically from above. Also proposed is a triggering mechanism with a safety device, which comprises a kinematic mechanism which is made up of a first lever mounted about a pivot point in the manner of a rocker and a second lever mounted about a further pivot point and interacting with a sear. Integrated in this kinematic mechanism are two safety devices, which only allow a shot to be fired when the falling-block breech action has been properly locked. This second safety device is realized by a further lever engaging under a firing pin system as a safety device parallel to the first safety device. This lever interacts with the kinematic mechanism, for which purpose a movable component that functionally connects the lever to the kinematic mechanism is incorporated. When locking of the breech has taken place, the movable component rests on the lever arm of the first (lower) lever of the kinematic mechanism. This ensures that over a displacement path the (upper) engagement moves away. Since the safety device lever has also released the firing pin system, the firing pin system with the firing pin is moved in a spring-assisted manner over the displacement path to be traveled by the firing pin for activating the percussion cap. This triggering mechanism forms the striking mechanism for the firing pin.

DE 10 2014 108 469, discloses a breech with a breech carrier and a breech head and also with a separate striking mechanism for triggering the firing pin incorporated in the breech head. The striking mechanism has at least one lever, preferably two levers, for engaging under a spring-tensioned sear. A rear tensioning ramp and a front ramp on the breech carrier serve for tensioning the spring of the sear in the striking mechanism and also additionally for pressing the at least one lever to disengage it from under the sear to release the sear. In the breech head, a firing pin safety device is also incorporated in the firing pin. This design obviates the need for an otherwise necessary firing pin spring. The firing pin can however only be fired without a cartridge when the breech head has been locked in the weapon by turning.

SUMMARY OF THE INVENTION

It is therefore an object of the present invention to provide a weapon system that allows a weapon to be designed in a simple and compact manner. It should at the same time preferably be possible for the weapon to be assembled and disassembled without tools, in particular for servicing and repair work. On the basis of the kind of kinematic mechanism and triggering mechanism mentioned above, i.e. this kind of striking mechanism, the invention has the object of presenting a striking mechanism which comprises a further safety aspect for safely firing a shot.

On the basis of the kind of kinematic mechanism and triggering mechanism mentioned above, i.e. this kind of striking mechanism, the invention has the further object of presenting a striking mechanism which comprises a further safety aspect for safely firing a shot.

In an exemplary embodiment, the invention is based on the idea of constructing the weapon in a completely modular manner, the individual parts being joined together to form modules and these modules holding or carrying one another. For this purpose, the weapon is divided into assemblies, which serve as carrier units of the individual parts and/or of the modular assemblies of the weapon. A first assembly here may be a modular weapon housing. The weapon housing is in this case the carrier unit for a breech system of the weapon with its individual parts, which is fitted in the carrier unit. The weapon housing module may also be supplemented by adding the weapon barrel(s) module. A further modular assembly is a weapon cradle. The weapon housing module with the breech system can be placed into this modular carrier unit and held by/in it. At the same time, sliding of the weapon housing in the weapon cradle (carriage-mounting) must be possible for a return of the weapon housing. Also attached to the weapon cradle is a further modular assembly, a weapon drive. This comprises an electrical external drive and also the mechanical breech drive, which for its part is connected to the breech system on the weapon housing. The breech drive moves the breech and includes within it the idle times of the breech in which it is deactivated.

The mechanical connections of the individual parts to the modular assemblies and of the modular assemblies to one another are primarily performed by way of systems of rails on the individual parts and corresponding guides, grooves, etc. on or in the assemblies. Furthermore, mechanical connections are created by holding-down devices, clearances, etc., bolts, pins and the like.

An assembly having individual parts is for example a striking mechanism of the weapon. This is joined together to form a modular assembly. Further individual parts of the weapon are for example a breech with a breech head (also known as a chamber), a pin, a breech block and a slide for controlling the breech and also the breech block. These aforementioned individual parts are inserted together with the striking mechanism into the weapon housing or are pushed onto the weapon housing. The individual parts then form together with the weapon housing a supplemented modular assembly.

Another idea that is taken up is that of likewise obviating the need for a spring for tensioning the firing pin. The force for moving the firing pin is applied by a striking hammer of a striking mechanism. For moving the firing pin by a predetermined displacement path in the breech head, the firing hammer is however only tensioned during the advancement of the slide, preferably after deactivation of the breech or the breech head in the locking position. In this case, only the spring of the striking hammer is tensioned. With the breech locked, the spring tension has the effect that the striking hammer is moved during its release in the direction of the firing pin and strikes the latter. The firing pin then discharges the shot. When the breech is opened and transported into its rear (unlocked) position, the spring for the striking hammer is relaxed again.

In the basic position (also known as the transporting position), when the breech is in its rear position, this spring, also referred to as the striking hammer spring, is consequently always relaxed. The spring is also durable. These properties ensure great functional dependability and reliability. The tensioning of the spring of the striking hammer in the forward movement of the breech head and release of the same achieve the effect that firing of a shot takes place independently of the speed of advancement of the breech, and consequently independently of the cadence. This is made possible by the tensioning taking place during the advancement of the breech and firing only being made possible in the completely locked position of the breech.

Since the firing pin does not have a firing pin spring of its own that brings the firing pin from a firing position into a rest position within the breech head, the firing pin is transferred from its firing position into its rest position by way of a carrier dog in interaction with the striking mechanism. This carrier dog becomes active when the breech is not yet completely disengaged but has already been moved into its rear position. For this transfer, the carrier dog for its part acts on a front striking surface in the end region of the firing pin. Before the breech is completely unlocked, the at least one carrier dog should have brought the firing pin into its rest position.

The displacement path over which the firing pin can travel to prime a percussion cap of a munition within the breech head is limited by a rear striking surface in the end region of the firing pin. In a preferred configuration, it is envisaged to incorporate this striking surface on the firing pin itself (firing pin projection). Alternatives are possible however. The carrier dog is for its part designed such that, for releasing the firing pin, it is also only away from the firing pin projection by the amount of this displacement path.

When returning the breech head, the firing pin is moved back by the carrier dog over the displacement path into the rest position and is then held in this position. The carrier dog is assisted in its function by a safety device, by which the firing pin is secured against movement of its own. For this purpose, in a preferred embodiment, incorporated in the end region of the firing pin is a clearance, in which a bridge or a connecting rod is placed. Alternatives are known.

The carrier dog may moreover also act as a safety device for the firing pin. The carrier dog lies permanently against the firing pin and only releases the firing pin shortly before the striking hammer is intended to hit the firing pin. This release takes place when the breech has been locked.

For the firing pin without a spring to be dependably carried along and guided, the carrier dog has lateral pins, which during the guiding of the breech or the breech head into its two end positions (forward, rear) slide in two grooves that lie opposite one another and extend laterally in the weapon housing. The carrier dog is forcibly guided by these grooves. The grooves ensure the contact of the carrier dog with the front striking surface of the firing pin.

The weapon housing supplemented by the added striking mechanism can then be placed into the weapon cradle, for example from above. The holding down of the weapon housing in the weapon cradle is performed by a rear holding-down device, which is pivotable, and also a front securing device on the weapon cradle. The holding-down devices achieve the effect that the weapon housing is not fixedly installed in the weapon cradle. This allows the weapon return/weapon advancement of the weapon housing in the weapon cradle (carriage mounting).

Furthermore, a modular return damping device is incorporated in the weapon. This preferably includes two return dampers, which for their part are only placed into clearances in the weapon cradle and the weapon housing and are integrated in the weapon in a simple manner. The return dampers are in this case fixedly integrated in the weapon cradle, but have a backlash in the weapon housing. The return dampers are secured by a securing device which can be fastened on the weapon cradle and is also used for holding down the front part of the weapon housing.

In a development of the invention, the weapon is especially configured by having a weapon barrel cluster module. This weapon barrel cluster comprises at least one weapon barrel, preferably a number of weapon barrels, which in the common weapon barrel cluster are mounted and held in preferably two bearings of the weapon barrel cluster. The fact that the weapon barrel cluster can only be formed of one or two weapon barrels results in that there is greater flexibility in satisfying customer requirements and/or that weight can be saved. For receiving the weapon barrel cluster, the weapon housing has a weapon barrel cluster securing device, which preferably has two fixed steady rests, which for their part have a swingable, removable or pivotable upper part. Incorporated in the upper part and in the lower part of the steady rests are rollers, which assist turning of the weapon barrel cluster. The incorporation of one roller in the upper part of the steady rest has been found to be sufficient.

The weapon drive module may also be flange-mounted on the weapon cradle module by way of a simple quick connection and pinned on it, for example by way of insert bolts. In this case, backlash in the fastening of the two to one another must be ruled out in order that the functional connection between a connecting rod and the slide of the breech remains ensured. The connecting rod of the drive and the slide of the breech can be easily connected to one another, for example by placing the connecting rod into a groove on the bottom of the slide. Since it is rare that these two modules have to be disconnected for servicing and/or maintenance, a screw connection may also be provided here.

The structural separation of the weapon drive from the weapon cradle has been found to provide the advantage that the modular weapon drive can be individually designed according to customer requirements, including with respect to the electrical drive, etc. The modular construction of the individual assemblies of the weapon and the use of individual parts that are themselves standardized also brings about the effect that the individual modules are consistently reproducible in their production, and consequently can be unproblematically exchanged for one another.

What is special about the weapon or this weapon system is that the fastening of the individual parts and the modular assemblies to one another is performed without tools. Tools are not necessary for disassembly either.

The proposed design is conceived here for a weapon of for example a caliber in the range of 7.62 mm, but can also be transferred to other calibers.

Proposed in particular is an externally powered weapon with at least one weapon barrel, a weapon housing, a breech system with a striking mechanism incorporated in the weapon housing, a weapon cradle and also a weapon drive, here a motorized (for self-powered weapons, another configuration known to a person skilled in the art, for example a gas piston, also see EP 2 440 881 B1, which is incorporated herein by reference) complementary drive, the breech system comprising a breech, a breech block, a firing pin and also a slide with control cams. For assembly/disassembly without tools, the weapon housing, the weapon cradle and also the weapon drive are configured as modular assemblies that serve as carrier units. In this case, the breech system is received by the weapon housing. The weapon housing has a receptacle in the weapon housing for the breech block and the striking mechanism. The breech and the slide have lateral rails and guides by way of which they can be mechanically connected to complementary rails and guides in the weapon housing by insertion and displacement. The weapon housing can be inserted into the weapon cradle. The weapon housing is held down without backlash in the weapon cradle by means of a holding-down device incorporated on the rear part of the weapon cradle and in the front region by means of a securing device in the weapon cradle. The at least one weapon barrel is carried by the weapon housing. The weapon drive carries at least the breech drive, preferably in the case of an external drive (motor) also the latter. An own drive may be connected to the weapon drive. The weapon drive may be releasably connectable to the weapon cradle. The breech drive of the weapon drive is functionally in connection with the slide on or in the weapon housing.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Right, left, forward/front and rear are considered in the firing direction and are thus defined.

Figure 1:
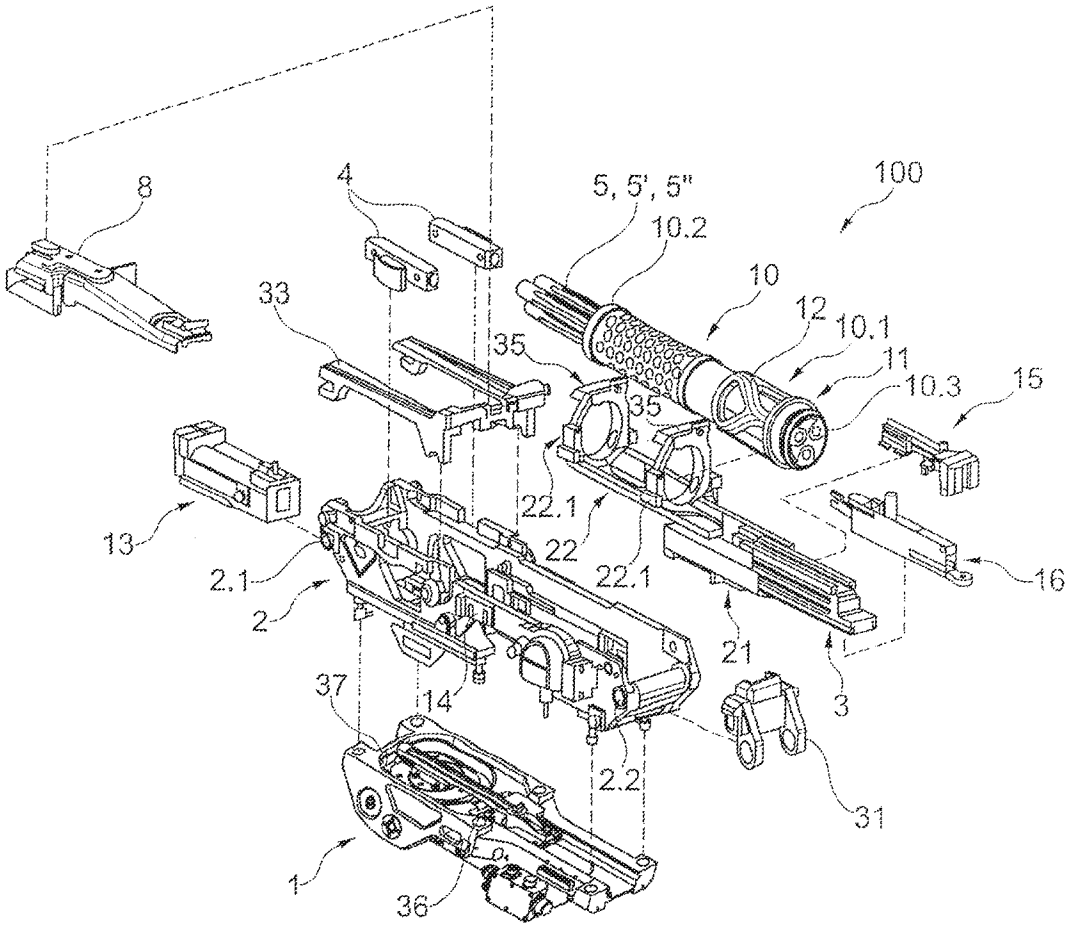
FIG. 1 shows an exploded representation of the individual modular assemblies and individual parts of a weapon.

In FIG. 1, an externally powered weapon 100 is shown in an exploded drawing. This weapon 100 is formed by individual modular assemblies, which together as a whole ensure the function of the weapon 100 and can be put together in a simple manner and can be mechanically connected to one another by way of a simple fastener. The basis of the modular assemblies are so-called carrier units (main assemblies), by which the stability of the weapon 100 is provided. They serve for receiving individual parts or the assemblies with one another. The modular main assemblies, assemblies and individual parts are preferably designed such that there is no need for tools to be used for assembly or disassembly.

The weapon 100 includes the main assemblies weapon drive 1, weapon cradle 2 and weapon housing 3. In the preferred configuration, the weapon 100 comprises not just one weapon barrel, but three (5, 5', 5"), which together form a weapon barrel cluster module 10.

Figure 3:
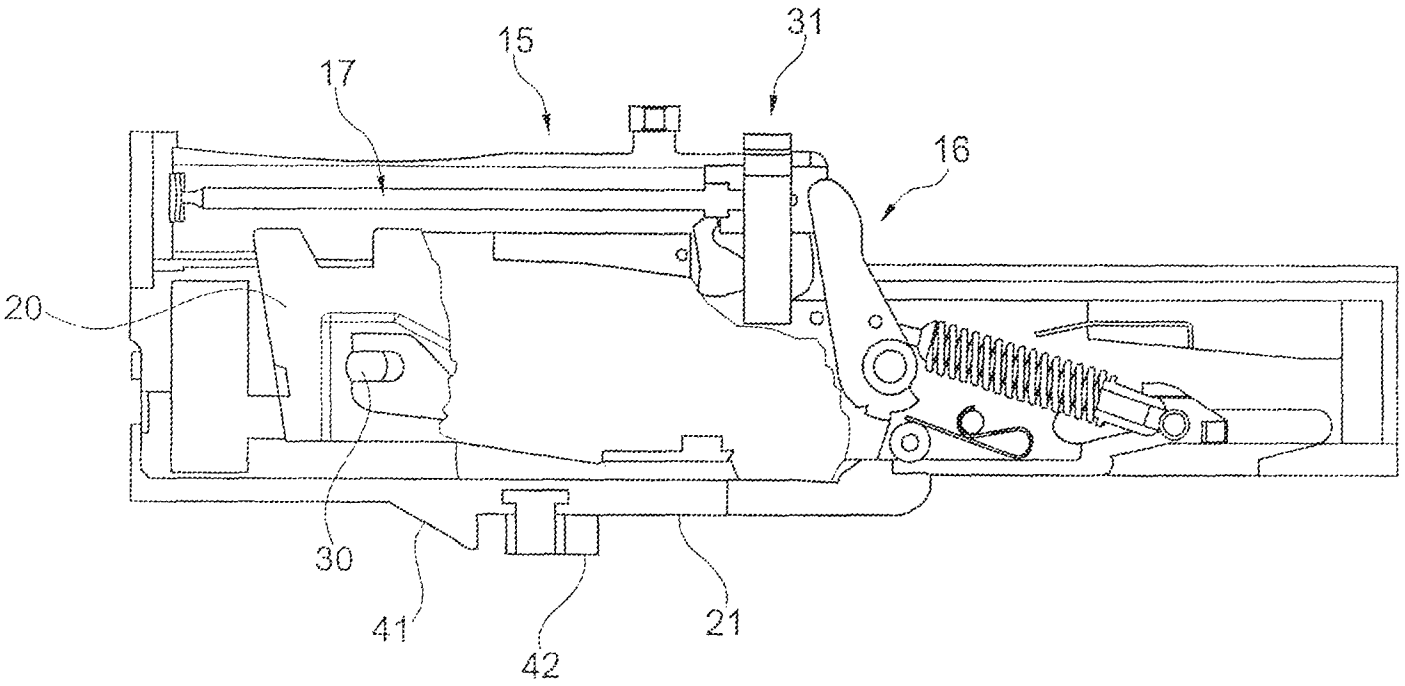
FIG. 3 shows the striking mechanism and the breech system in the assembled state (partly in section)

The weapon housing module 3 serves for receiving the individual parts of the breech system comprising a breech 15 with a breech bolt or breech head 15.1, the striking mechanism 16 and also a firing pin 17, a breech block 20 and a slide 21 (control block) (FIG. 3). The striking mechanism 16, which forms the trigger device of the weapon 100, is integrated in a trigger housing 100.1 and the latter is integrated in the weapon housing 3. The trigger housing 100.1 is a modular part of the weapon 100 and forms a self-contained and functional unit.

A case ejector 18, which engages in a groove 19 in the breech head 15.1, has been pushed laterally into a groove in the weapon housing 3 and anchored in it. This brings about the effect of a reproducible ejection of a cartridge case not represented any more specifically after firing of the munition, when the breech 15 is guided to the rear.

The weapon barrel cluster 10 has in a partial region 10.1 a control body 11, which peripherally has a control cam 12, with which the weapon barrel cluster 10 can be turned about a common barrel cluster axis. The weapon barrels 5, 5', 5" are for their part mounted in a front bearing 10.1 and a rear bushing 10.2 in the weapon barrel cluster 10 and are incorporated in the latter in the manner of a drum. In the rear bushing 10.2, the weapon barrels 5, 5', 5" are preferably caulked. Provided for the turning is a drive 13, preferably an electrical drive, which is configured as a module. Since it is not in continuous use, the drive 13 may be powered by batteries that are not represented any more specifically. Alternatively, the drive 13 may be supplied with power by way of a power cable.

In the front region (FIG. 2), the weapon housing 3 has a barrel receptacle or barrel securing device 22, into which the weapon barrel cluster 10, comprising for example three weapon barrels 5, 5', 5", is placed and is held thereby. The barrel securing device 22 is formed by two fixed steady rests 22.1, which each have a swingable, removable or pivotable upper part 22.2, so that the weapon barrel cluster 10 can be placed into the steady rests 22.1. The upper part 22.2 is formed here as a quick closure. The weapon barrel cluster 10 may also comprise just one or two weapon barrels 5, 5'. The mounting in the weapon barrel cluster 10 can in this case remain the same.

The weapon cradle module 2 (FIG. 4) is likewise based on a carrier unit and serves for receiving the weapon housing 3 and also all the components or assemblies of the weapon 100. The components to be received are the drive 13, a return damping device 4, the weapon housing 3 supplemented by adding the breech system and striking mechanism 16, with the case ejector 18 and also the weapon barrel cluster 10.

A T groove 14 incorporated on both sides on the outside of the weapon cradle 2 may be used for receiving further add-on parts such as an ejecting plate 14.1, a munition feed, etc., which can be pushed into the T groove 14.

The internal return in the cradle provides that it is not necessary for the weapon 100 to be mounted on a carriage. The weapon cradle 2 itself forms the carriage-mounting for the weapon 100, by way of which the weapon 100 can be carriage-mounted on a vehicle, etc. For carriage-mounting the weapon 100, the weapon 2 has two bearing points 2.1, 2.2.

Figure 1A:
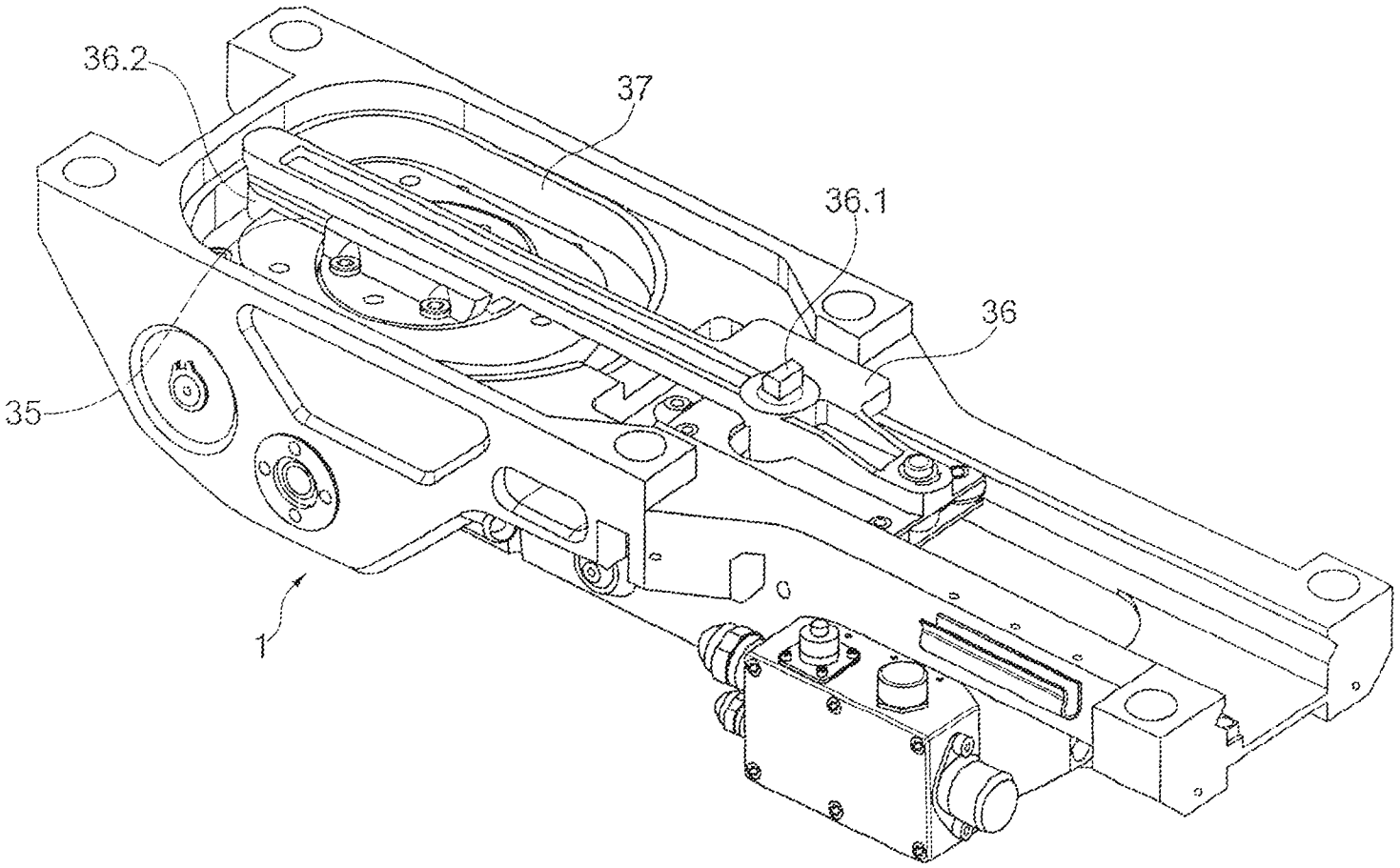
FIG. 1*a* shows a breech drive in a representation in plan view.

Here, the weapon drive module 1 (FIG. 1*a*) is an electrical drive that is not represented any more specifically, as an external drive 1.1 of the weapon 100. Likewise incorporated in this module on both sides is a breech drive connected to the drive 1.1, here a connecting rod 36 (FIG. 1*a*), which is guided by way of a crank 35 along a drive cam 37.

The connecting rod 36 is guided in the drive cam 37, which defines the idle times of the weapon 100 or of the breech 15 (also see in this respect DE 10 2008 060 217 A1). A front cam 36.2 of the connecting rod 36 thereby engages in the drive cam 37 and a rear cam 36.1 behind a lug, for example a fixed lug 41, of the slide 21. The length compensation between the connecting rod 36 and the drive cam 37 takes place by the crank 35. Behind the fixed lug 41 there is for example a movable slide 42, by which the connecting rod 36 transports the breech 15 back into the rear position when a shot has been fired, but prevents the breech 15 from being transported if no shot has been discharged. The backlash or the distance between the lug 41 and the movable slide 42 corresponds to the displacement path by which the weapon returns, so that it cannot exert any force on the weapon drive (FIG. 3). As already explained, the breech system of the weapon 100 is controlled by way of the slide 21 (also see DE 10 2009 011 939 A1).

In a special configuration, an emergency stop device 40 which is integrated in the weapon cradle 2 and is actuated by the return of the weapon interacts with the movable slide 42. If the return of the weapon does not take place, the emergency stop by the emergency stop device 40 remains engaged.

As a further safety device, during transport of the weapon or of an object carrying the weapon, such as vehicles of all kinds, the weapon barrel cluster 10 may be transferred into a transporting position, the control cam 12 only making a half turn, and the weapon barrel 5 (5', 5") thereby being brought out of line with the breech 15.

The actual assembly, i.e. the putting together of the weapon 100, is now to be explained in more detail on the basis of FIGS. 2 to 9.

Figure 2:
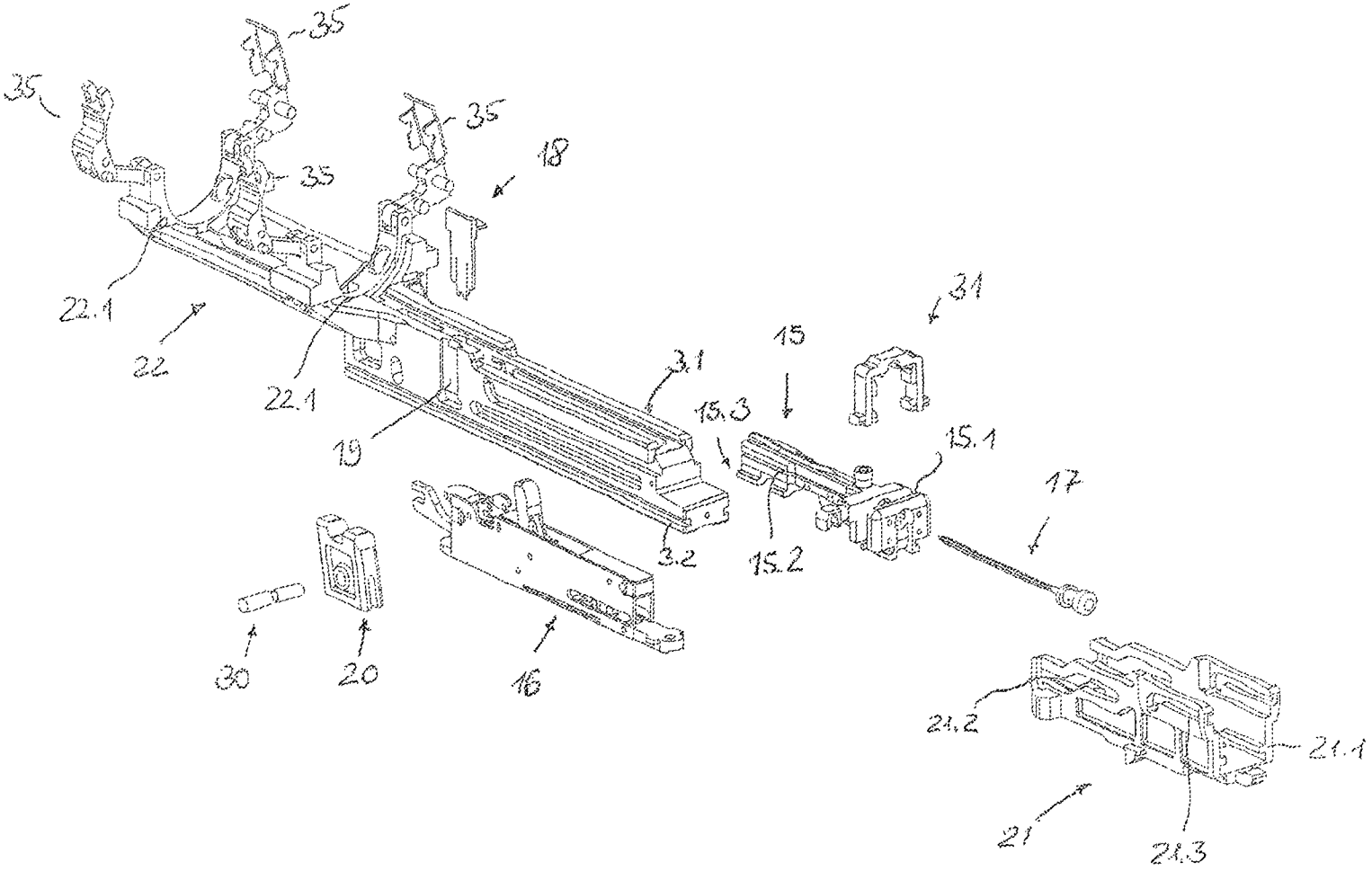
FIG. 2 shows an exploded representation of the weapon housing with striking mechanism subassembly with the individual parts of the breech system from FIG. 1.

In a first assembly step, the unit comprising the striking mechanism 16 with the breech block 20, the breech 15 or breech head 15.1 and also the slide 21 is fastened in the weapon housing 3 (FIG. 2). The slide 21 is preferably u-shaped and reaches around the weapon housing 3 from below. The striking mechanism 16 and the breech block 20 are introduced into a trigger housing 100.1 and inserted into the weapon housing 3 from below. The receptacle in the weapon housing 3 for the trigger housing 100.1 with striking mechanisms 16 and breech block 20 are structurally made to match one another in such a way that a positively locking fitting is achieved. The fitting of the firing pin 17 into the breech 15 or breech head 15.1 is performed before the insertion of the breech 15 into the weapon housing 3.

The fastening of the breech 15 and of the slide 21 on the weapon housing 3 is performed by way of rails/guides/grooves 15.2 on the breech 15 and rails/guides/grooves 21.1 on the slide 21 and also matching rails/guides 3.1 (and grooves) on the weapon housing 3. The breech 15 and the slide 21 are pushed onto the carrier or the weapon housing 3. The pin 30 reaches through the hole in the breech block 20, preferably into a further control cam (not represented any more specifically) located behind and parallel to the front control cam 21.2.

Figure 4:
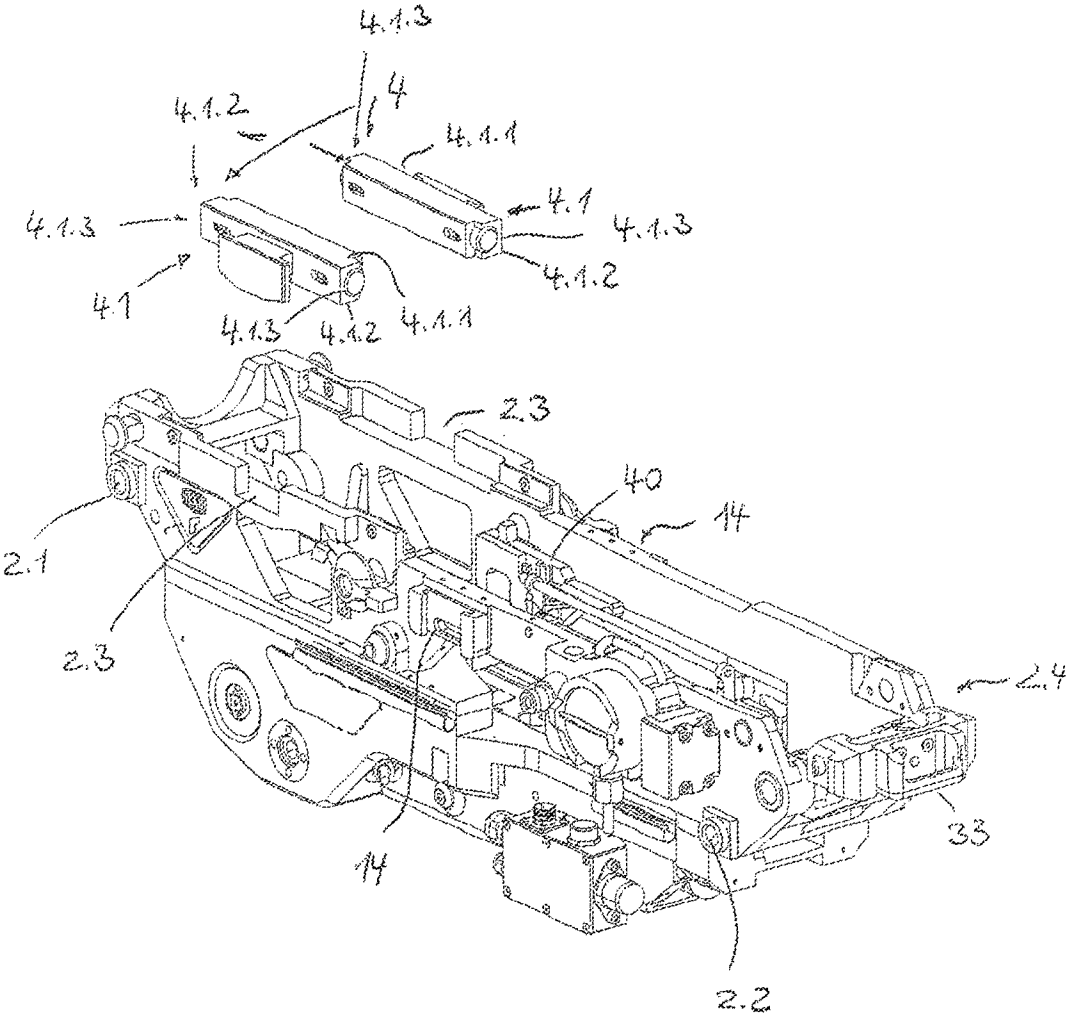
FIG. 4 shows a representation of the placing of the return damping device from FIG. 1 into the weapon.

Then, the modular return damping device 4 can be placed into the weapon 100 (FIG. 4). The return damping device 4 used here comprises two return dampers 4.1, formed of a housing 4.1.1 for receiving a spring (not represented any more specifically) and bolts 4.1.3 attached on both sides to the end faces 4.1.2 of the housing 4.1.1, a front bolt and a rear bolt. These return dampers 4.1 are inserted into clearances 2.3 in the weapon cradle 2 and also into cooperating clearances 3.3 in the weapon housing 3. The return dampers 4.1 are in this case fixedly integrated in the weapon cradle 2, but later have a backlash in the weapon housing 3.

Figures 5, 5A, 5B:
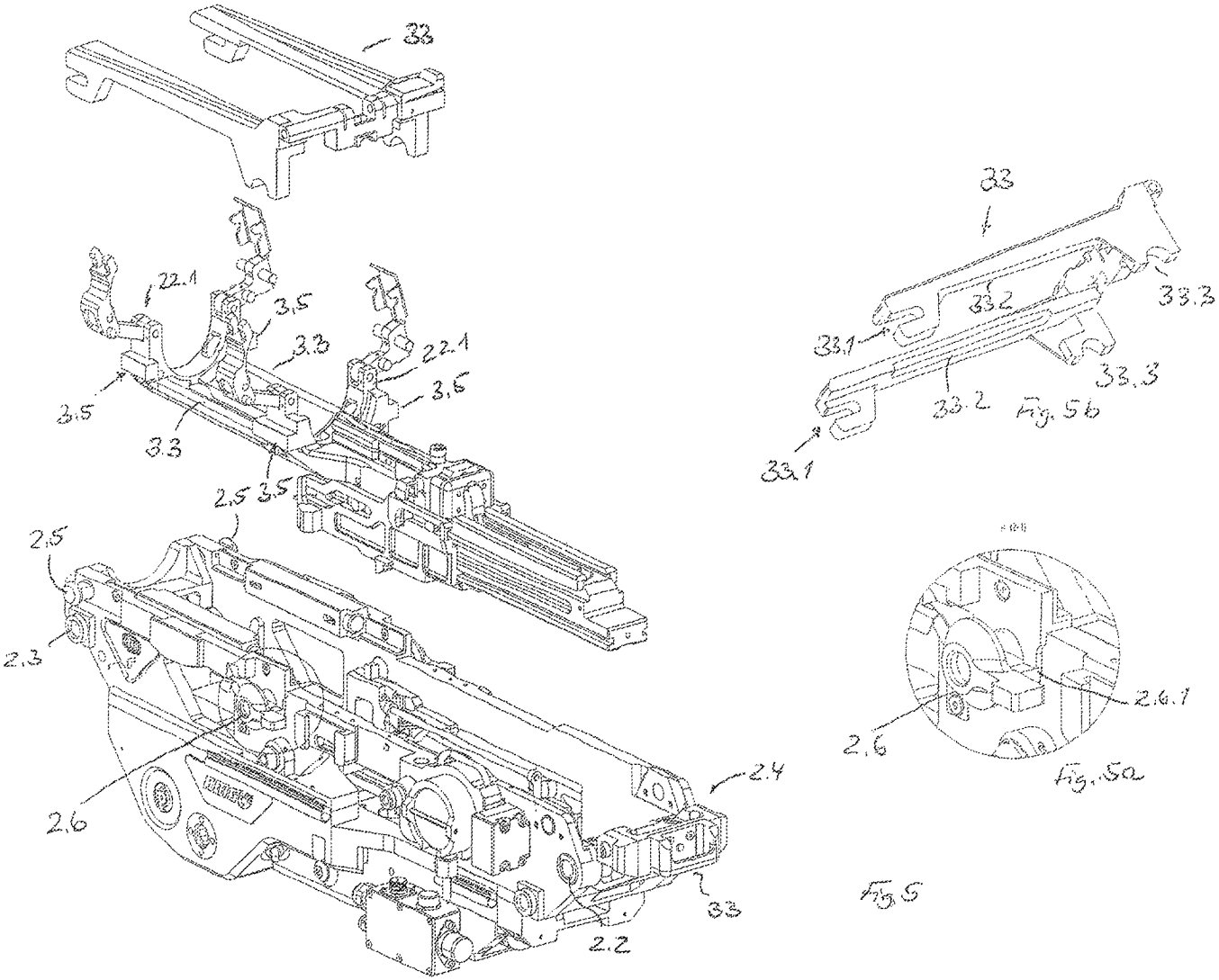
FIGS. 5, 5*a* and 5*b* shows a perspective representation of further assemblies to be assembled with one another and their connecting parts.

After that, the modular weapon housing 3 fitted with the aforementioned assemblies can be placed into the weapon cradle module 2 (FIG. 5). The placement is performed here from above. A holding-down device 31 fixedly incorporated at the rear end 2.2 of the weapon cradle 2 can be swung away about an axis. After the placing in of the weapon housing 3, the holding-down device 31 can be swung forward, whereby the weapon housing 3 is held down in the rear region.

Figure 6A:
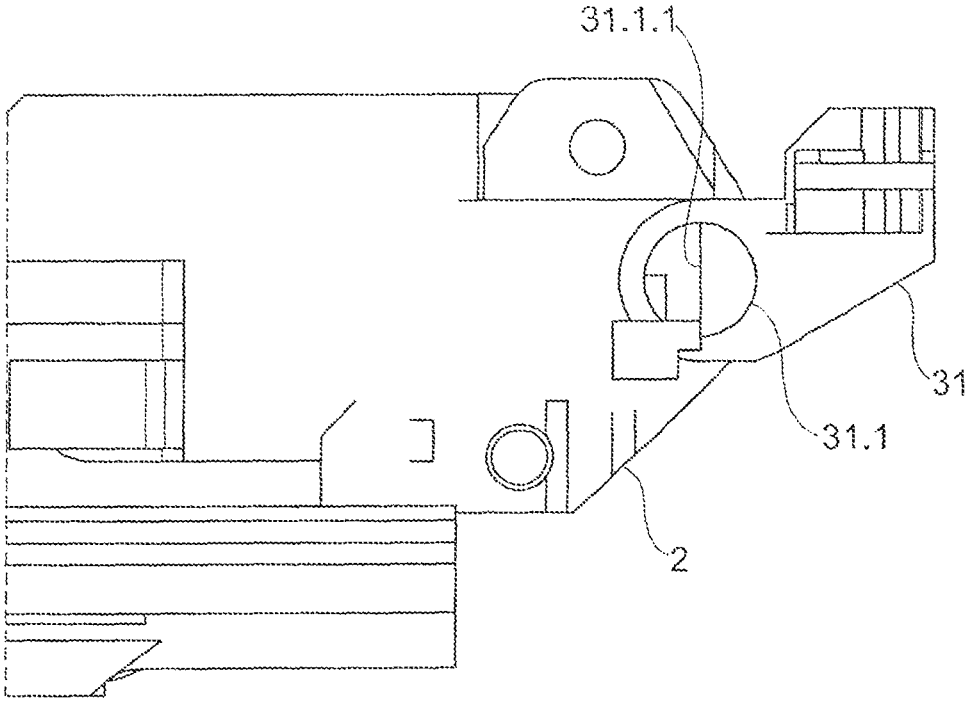
FIGS. 6*a* and 6*b* show a sectional representation of a rear holding-down device in the open position and in the functional position.
Figure 6B:
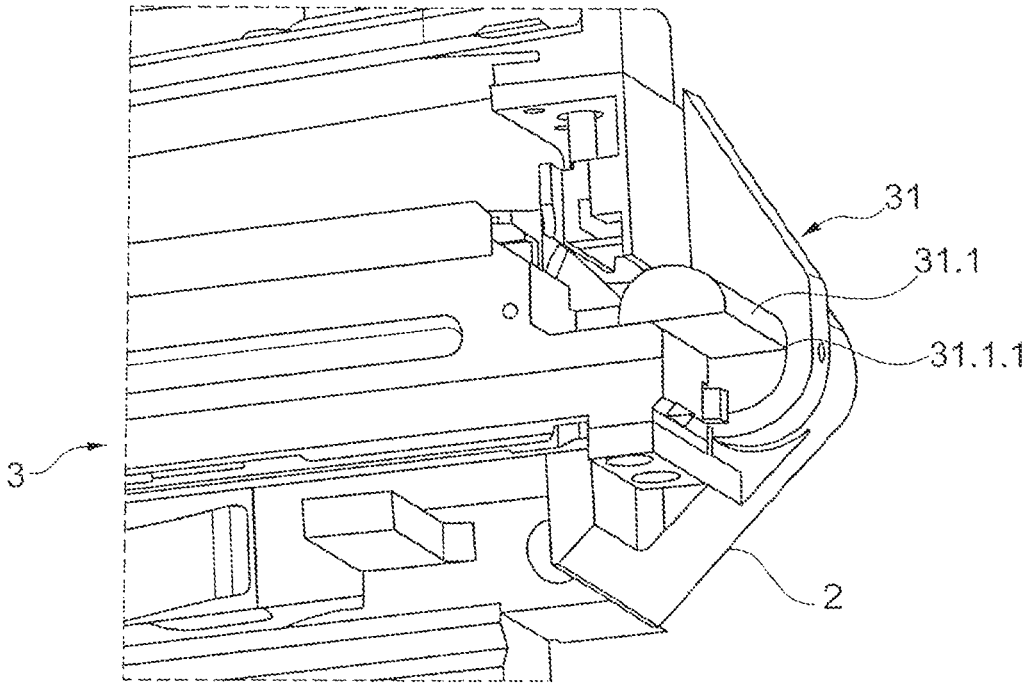

This holding-down device 31 is represented more specifically in FIG. 6*a*, 6*b*. It has a bolt 31.1, which between its restraints is flattened on one side, so that in this region the bolt 31.1 has a half-round form. For introducing the weapon housing 3, this bolt 31.1 stands perpendicularly in the weapon cradle 2. For holding down the rear end of the weapon housing 3 in the weapon cradle 2, as already mentioned, the holding-down device 31 is swung forward/upward, so that the surface of the half-round region of the bolt 31.1 comes to lie above the end of the weapon housing 3 and weapon housing 3 is held in the rear region of the weapon cradle 2 with little backlash, but sliding of the weapon barrel housing 3 in the weapon cradle 2 is ensured.

The front holding down of the weapon housing 3 in the weapon cradle 2 is assumed by a securing device 33, which is configured in a u-shaped manner in the vertical plane and rests with its legs on the weapon housing 3 in the front region with little backlash (FIG. 5). This securing device 33 also serves for safely securing the return damping device 4 in the weapon cradle 2 and also in the weapon housing 3. The securing device 33 acts by way of its front clearances or forks 33.1 of the legs on bolts 2.5 of the weapon cradle 2. The latter have a corresponding guide 2.5.1. In the rear region of the legs, the securing device 33 has clearances 33.2 on both sides, which are placed onto guides 3.5 of the weapon housing 3. The rear bearing locations 33.3 (FIG. 5.1) of the securing device 33 are locked by corresponding bolts 2.6 (on both sides) on the weapon cradle 2. FIG. 5.2 shows these bolts 2.6, configured as locking bolts. These also have a half-round form with a flattened surface. When the bearing locations 33.3 rest on the flattened surface of the locking bolts 2.6, the locking bolts 2.6 are turned forward, the half-round form engaging in the half-round (complementary) clearances of the bearing locations 33.3 and preventing the securing device 33 from moving back.

Figure 7:
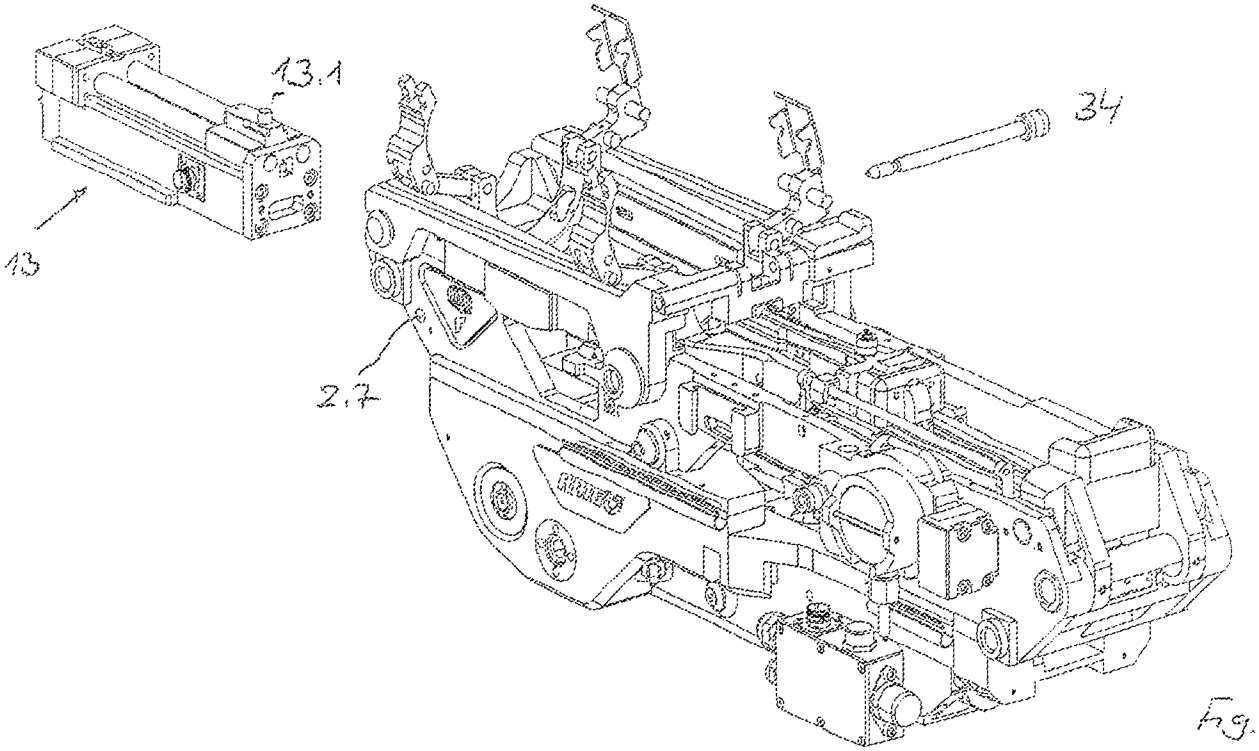
FIG. 7 shows a perspective representation of the incorporation of the barrel changing drive from FIG. 1 in the weapon.

The placing of the barrel changing drive 13 into the barrel cradle 2 is performed in a structural space intended for receiving it (FIG. 7). The barrel changing drive 13 is preferably pushed into a T groove in the weapon cradle 2. The T groove should be incorporated in the lower part of the weapon cradle 2. A drive cam 13.1 faces upward after the incorporation of the barrel changing drive 13, so that it unproblematically engages in the control cam 12 of the control body 11 of the modular weapon barrel cluster 10 to be fitted, with the incorporation of the weapon barrel cluster 10. The barrel changing drive 13 is mechanically secured in the weapon cradle 2 by a pin 34, which is introduced behind the barrel changing drive 13 in a manner penetrating the weapon cradle 2 on both sides.

Figure 8:
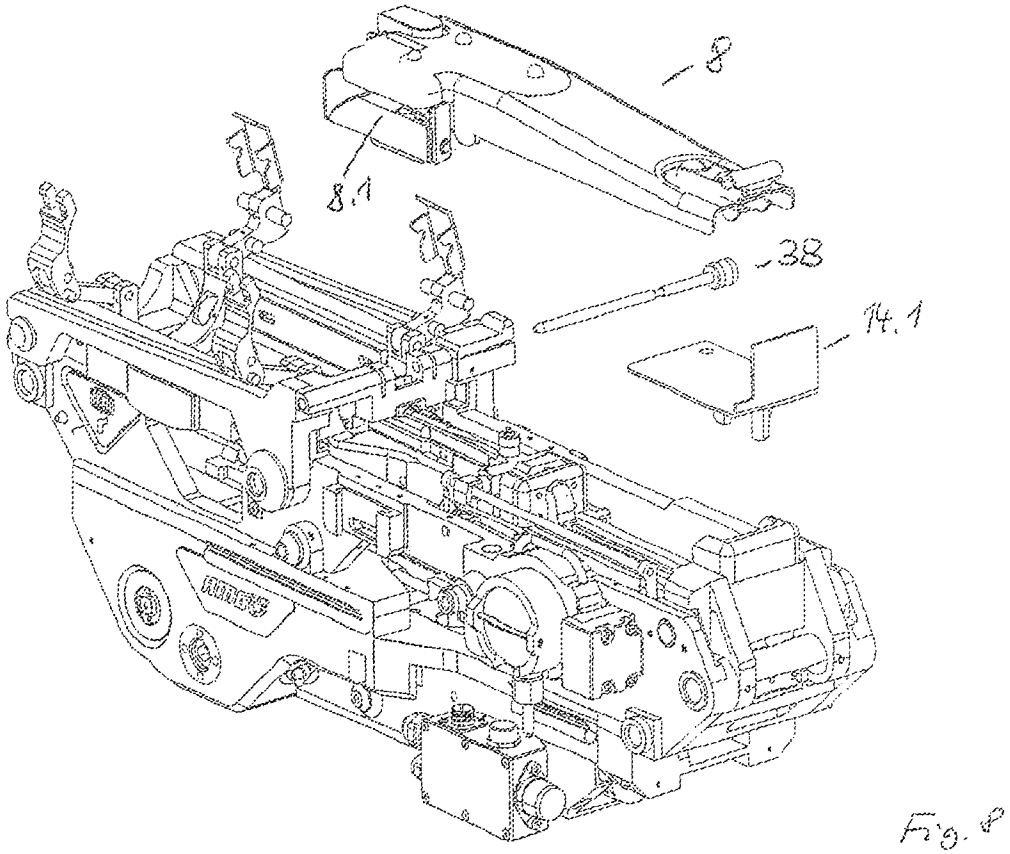
FIG. 8 shows a perspective representation of the incorporation of the feeder from FIG. 1 in the weapon.

In a next step, the feeder 8 can be mounted in or on the weapon 100 (FIG. 8). The feeder 8 is fastened with its upwardly swingable feeder upper part 8.1 by way of a further pin 38, here at the rear end of the securing device 33. The feeder 8 is in this case located in the region of the ejecting guide of the weapon cradle 2.

Figure 9:
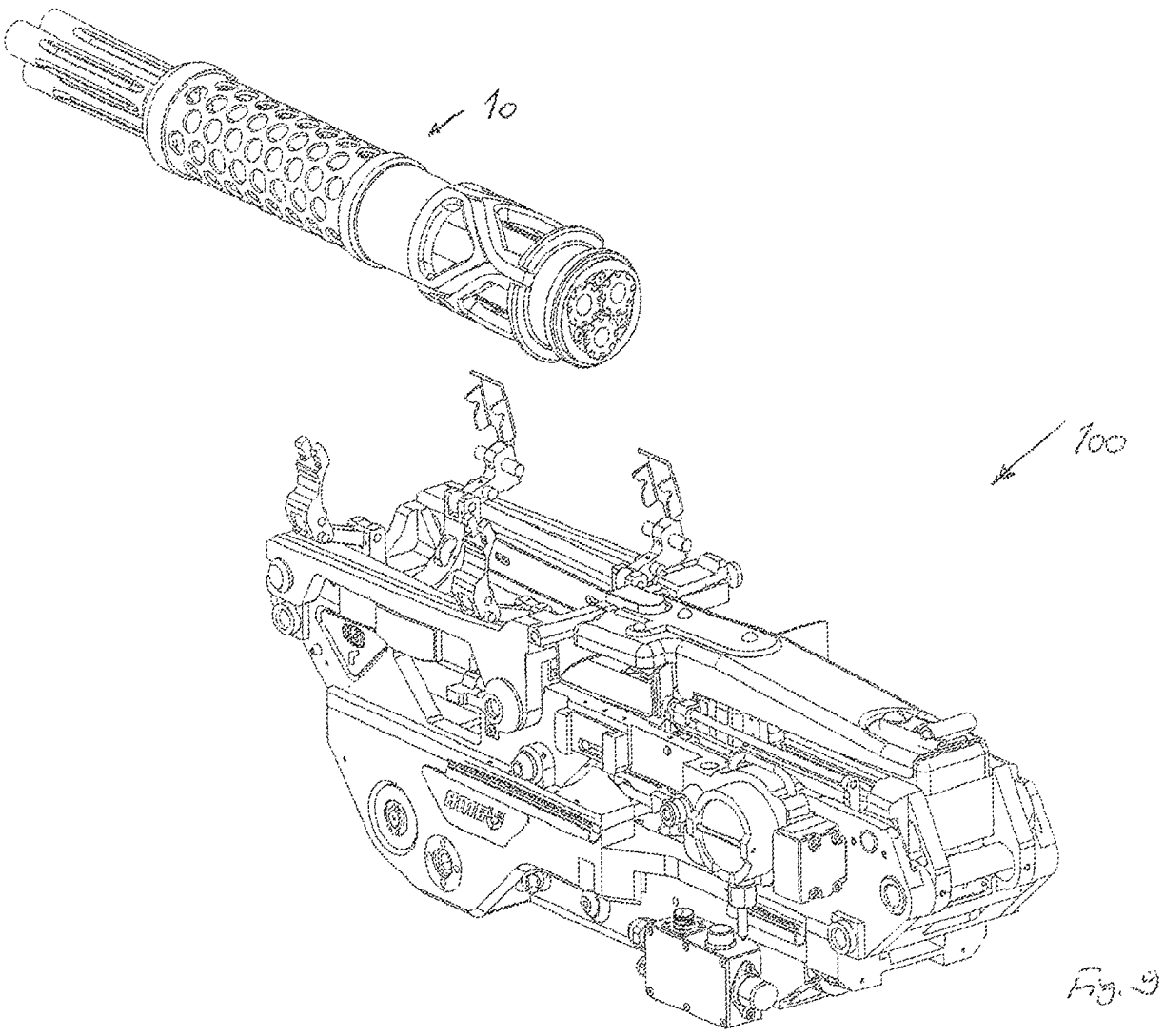
FIG. 9 shows a perspective representation of the incorporation of the weapon barrel cluster from FIG. 1 in the weapon.

The incorporation of the weapon barrel cluster 10 takes place by placing it into provided barrel securing devices 22 (steady rests 22.1) of the weapon housing 3 (FIG. 9). Mounted on these barrel securing devices 22 are quick closures 22.2, which allow changing fastening of the barrel securing devices 22. During the fitting, the drive cam 13.1 of the drive 13 engages in the control cam 12. With the fitting of the barrel weapon cluster 10, a weapon barrel 5, 5', 5" of the weapon barrel cluster 10 is aligned with the breech 15.

It goes without saying that the weapon barrel cluster 10 may have just one weapon barrel 5 or also two weapon barrels 5, 5'. The weapon barrel cluster module 10 allows these variants without any problem.

When the weapon drive module 1 is mechanically connected to the weapon cradle module 2 by way of quick connections (not represented any more specifically) and, before that, the connecting rod 36 is connected to the carriage or slide 21, the weapon 100 is completely assembled and functionally ready to operate as soon as the weapon drive 1.1 (here a motor) is supplied with power.

Figure 10:
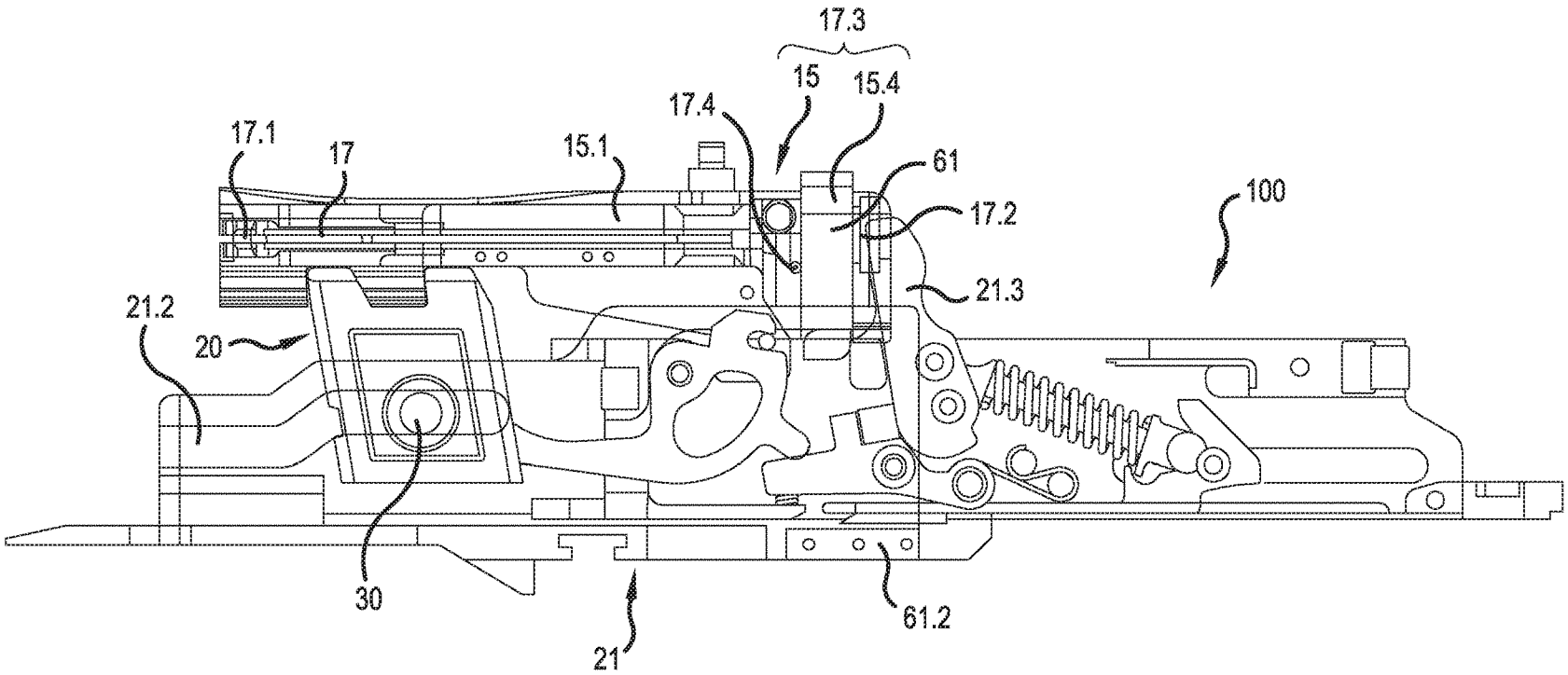
FIG. 10 shows a representation of the breech system from FIG. 1 in an easily transparent form in the locked forward position of the breech and the fired-without-cartridge position of the firing pin with the striking mechanism.
Figure 11:
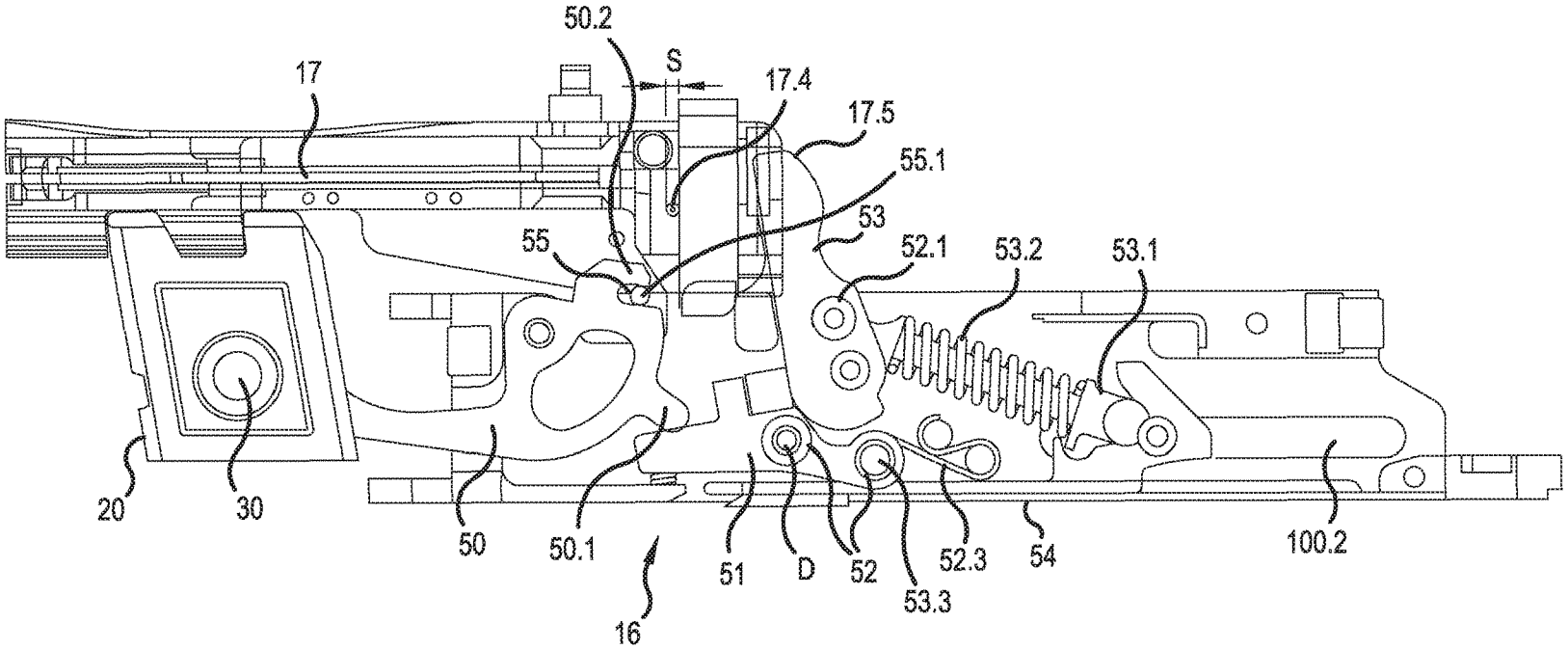
FIG. 11 shows a more detailed representation from FIG. 10.

FIGS. 10 and 11 show an easily transparent representation of the breech 15 of the weapon 100. In the embodiment described here, the breech 15 or its breech head 15.1 is locked by the breech block 20 (FIG. 3). It should be noted at this point that the embodiment of a falling-block breech action is not restrictive. As already explained, the slide 21, also known as a control slide, with its incorporated control cams 21.2, 21.3, serves for transporting the breech 15 or the breech head 15.1 and also for controlling the breech block 20. The control cams 21.2, 21.3 are preferably incorporated in the slide 21 on both sides. The pin 30 guided by the front control cam 21.2 of the control slide 6 functionally connects the breech block 20 and the striking mechanism 16 to the control slide 21. The breech block 20 is controlled by this pin 30. In the deactivated forward position of the breech 15, if the weapon drive continues to run but the breech 15 itself is not moved any further, the breech 15 is locked by the moving up of the breech block 20 along the control cam 21.2, and the striking mechanism 16 is released. After a shot has been fired, the breech 15 is unlocked again with the return of the weapon.

Guided in the second control cam 21.3 is the further, here u-shaped, connecting rod 61, which engages from above in a clearance 15.3 in the breech 15 or the breech head 15.1. When the breech 15 has been locked in its forward, deactivated position by the breech block 20 moved up by means of the front control cam 21.2, the firing pin 17 is released by the second control cam 21.3. For this purpose, the connecting rod 61 is guided along the rear, second control cam 21.3 out of the clearance 15.3. In this position, the weapon housing 3 has a correspondingly upwardly directed pocket 3.2, which allows the connecting rod 61 to be made to extend.

As already described, the control slide 21 is moved by the breech drive. The breech drive is designed such that, in its forward and rear positions, the breech 15 is in each case deactivated, the locking of the breech 15 taking place in the forward position and a munition that is not represented any more specifically being presented to the breech 15 in the rear position. In the deactivated positions, the control slide 21 continues to run. In particular in the forward deactivated position of the breech 15, the locking is then initiated and carried out by the still running control slide 21.

Incorporated in the breech head 15.1 is the firing pin 17 for igniting the munition that is not represented any more specifically. This firing pin 17 has a tip 17.1 at the front and a base 17.2 in the end region 17.3. A striking surface of the firing pin 17 in the end region 17.3 is identified by 17.4. In the preferred configuration, the firing pin 16 is incorporated in the weapon housing 3 underneath the breech 15.

The striking mechanism 16 comprises a trigger rocker 50, which is in functional connection with the breech block 20 by way of the pin 30. The trigger rocker 50 for its part acts on a safety device 51 for a release 52 and the latter functionally interacts with a striking hammer 53. For its actuation, the striking hammer 53 receives a telescopic pushrod 53.1. The pushrod 53.1 is supported by its other end on a tensioning slide 54, which is in mechanical connection with the control slide 21. Mounted around the telescopic pushrod 53.1 is a spring 53.2.

The trigger rocker 50 acts with a lug 50.1 on the safety device 51 and can press it down. On the upper edge, the trigger rocker 50 has a claw 50.2. This claw 50.2 serves for receiving a carrier dog 55 that acts on a front striking surface 17.4 and comes into contact with the claw 50.2 when the breech 15 has been fed and deactivated. The carrier dog 55 is for its part designed such that it lies against a front striking surface 17.4 of the firing pin 17 and can be pivoted about a pivot point. The striking surface 17.4 of the firing pin 17 is preferably incorporated in a projecting manner as a firing pin projection 17.4. The rear striking surface 17.5 (rear firing pin projection) in the end region 17.3 of the firing pin 17 defines a displacement path S, over which the firing pin 17 moves in order to be brought into its igniting position (firing position).

For the firing pin 17 without a spring to be dependably carried along and guided, preferably two carrier dogs 55 are incorporated. These also have in each case a lateral pin 55.1. During the transport of the breech 15 into its rear position and forward position, these pins 55.1 respectively slide together with the firing pin 17 and the breech 15 in an associated guide 3.1 or groove incorporated laterally in the weapon housing 3 (FIG. 10).

Figure 12:
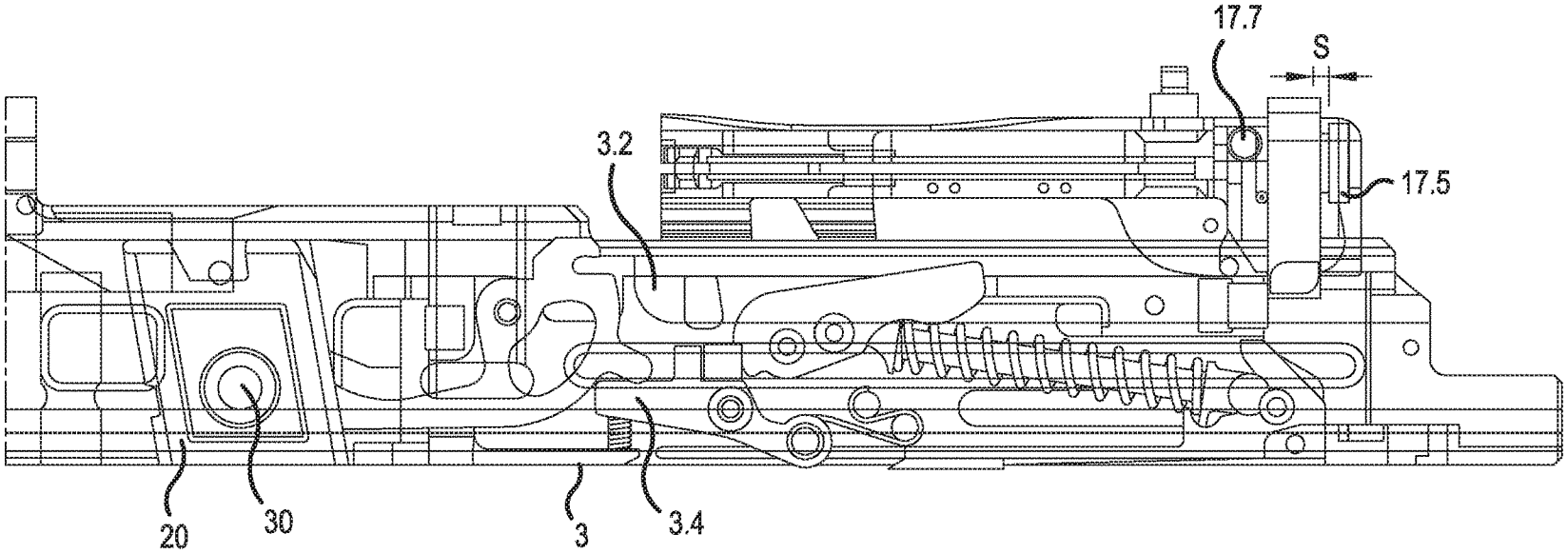
FIG. 12 shows a representation of the breech system from FIG. 1 in an easily transparent form in the unlocked rear position.
Figure 13:
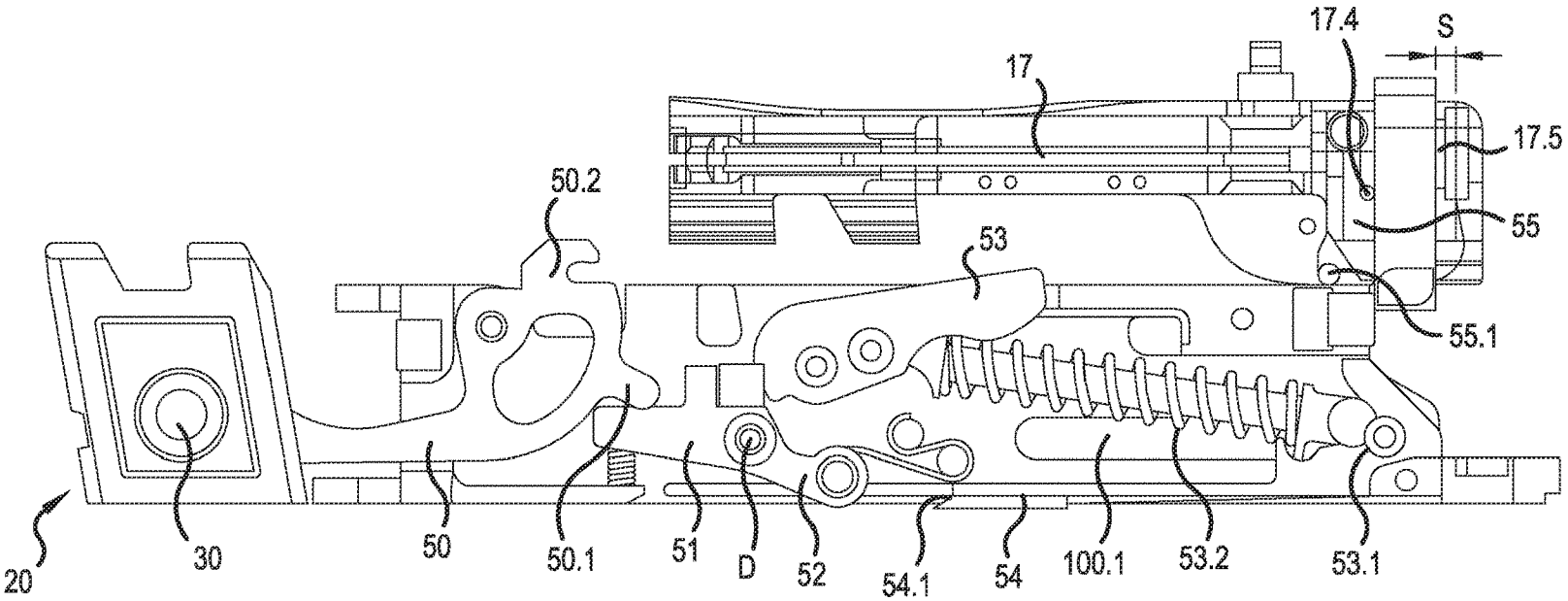
FIG. 13 shows a more detailed representation from FIG. 12.

FIGS. 12 and 13 show the interaction of the individual striking mechanism parts in the deactivated rear position of the breech 15 or of the breech head 15.1.

With a resting, relaxed spring 53.2, the striking hammer 53 lies underneath the breech head 15.1 in the striking mechanism 16. The breech block 20 is in its rest position and is deactivated. The trigger rocker 50 has been pulled down and is not exerting any pressure on the safety device 51. The safety device 51 is blocking the trigger 52, which engages with its catching edge 52.1 under the catching edge 53.3 of the striking hammer 53.

When there is forward movement of the slide 21, and consequently of the breech 15, the tensioning slide 54, which also brings about the release of the striking hammer 53 and thereby of the shot, is also moved. The pushrod 53.1 of the striking hammer 53 is guided along a slot 100.2, which is in the trigger housing 100.1 of the weapon 100. In the deactivated forward position of the breech 15, if the breech drive and the control slide 21 continue to run but the breech 15 itself is not moved any further, the spring 53.2 is partially tensioned. The spring 53.2 is then tensioned by the continued running oft he control slide 21 and consequently of the tensioning slide 54. The breech 15 is locked by the moving up of the breech block 20 along the control cam 21.2.

With the moving up of the breech block 20, the trigger rocker 50 is pressed against a spring 51.1 of the safety device 51. The trigger rocker 50 at the same time pulls down with it the carrier dog 55, which ran into the clearance 50.3 when the breech head 15.1 advanced. For this purpose, the weapon housing 3 has on both sides a downwardly facing pocket 3.4 for the downward yielding of the pins 55.1 of the carrier dog 55. This downward displacement path that is incorporated in the pocket 3.4 should correspond to the displacement path S of the firing pin 17 that the latter requires for its function as a triggering mechanism. The carrier dog 55 thereby releases the firing pin 17.

At the same time, the trigger rocker 50 presses against the safety device 51, and consequently against the spring 51.1. With the pressing down of the safety device 51, the latter releases the displacement path for the trigger 52. The engagement of the striking hammer 53 on the catching edge 52.1 of the trigger 52 persists. This holding is assisted by a trigger spring 52.3.

Guided here in the second control cam 21.3 of the control slide 21 is the further, here u-shaped, connecting rod 61 or bridge, which engages from above by way of its clearance 61.3 in a clearance 15.4 in the breech head 15.1 and also in a clearance 17.6 (FIG. 3) in the firing pin 17. When the breech 15 has been locked in its forward, deactivated position by the breech block 20 moved up by means of the front control cam 21.2, the firing pin 17 is released by the second control cam 21.3. For this purpose, the connecting rod 61 is guided along the rear control cam 21.3 out of the clearance 15.4 of the breech (FIG. 10). This connecting rod 61, serving as a further safety device, releases the firing pin 17. For this release by the connecting rod 61, the weapon housing 3 has on both sides an upwardly facing chamber or pocket 3.2, into which the connecting rod 61 can escape from its guide in the weapon housing 3. In order that the connecting rod 61 firmly and securely holds the firing pin 17 during the transport of the breech 15 or of the breech head 15.1, this connecting rod 61 is also forcibly guided on both sides in lateral guides/grooves in the weapon housing 3 (not represented any more specifically). The u-shaped connecting rod 61 for its part engages by way of a journal 61.2 of the connecting rod 61 in the cam 21.3 of the control slide 21 and with an oppositely located journal 61.1 in a corresponding groove/guide 3.1 of the weapon housing 3.

Then, all of the safety devices for the firing pin 17 have been released.

The actual mechanical triggering of the striking hammer 53 takes place by the tensioning slide 54 (FIG. 11, 12). This has a run-up ramp (slope) 54.1. The ramp 54.1 moves under the trigger 52, along which a roller 54.2 is guided. By changing the position of the rollers 54.2, the trigger 52 is pivoted about a pivot point D, whereby the catching edge 52.1 of the trigger 52 is removed from the catching edge 53.3 of the striking hammer 53. The ramp 54.1 determines the triggering time, i.e. the igniting time. The later the ramp 54.1 meets the trigger 53, the later the shot is discharged. The spring-loaded striking hammer 53 then strikes against the free firing pin 17, whereby a movement of the firing pin 17 is brought about. This displacement path S of the firing pin 17 is limited by the rear striking surface 17.5 of the firing pin 17.

The trigger rocker 50 in interaction with the carrier dog 55 can also serve for limiting the displacement path of the firing pin 17. In this case, the carrier dog 55 acts on the front striking surface 17.4 of the firing pin 17 when it has traveled over the displacement path S.

When the shot is discharged and the control slide 21 transfers the breech 15 or the breech head 15.1 back into its rear position, the breech block 20 is deactivated. The trigger rocker 50 is moved up. The (hammer) spring 53.2 is completely relaxed again by way of the tensioning slide 54 and the striking hammer 53 is pressed to the rear by the breech 15 or the breech head 15.1 itself and deactivated (held). With the sliding back of the tensioning slide 54, the roller 52.2 of the trigger 52 is transferred by way of its trigger spring 52.3 into its original position. In this case, the trigger 52 is turned back about the pivot point D. After that, the safety device 51 for the trigger 52 is placed over the spring 52.3. This sequence takes place in an extremely short time.

As long as the breech 15 is acting on the relaxed striking hammer 53 brought rearwardly into the weapon housing 3 or into the trigger housing 100.1, the catching edge 52.1 of the trigger 52 and the catching edge 53.3 of the striking hammer 53 are not in direct engagement. With the advancement of the breech 15 and the emergence of the striking hammer 53 from the weapon housing 3 (trigger housing 100.1), its catching edge 53.3 impinges on the awaiting catching edge 52.1 of the trigger 52.

For the weapon 100 to function or operate without canting, a forcible guidance of all the movable components of the weapon 100 is provided (increasing the safety and also the functional dependability). The weapon housing 3 therefore also has on both sides a groove or guide for guiding the pins 55.1 of the carrier dog 55.

Figure 14:
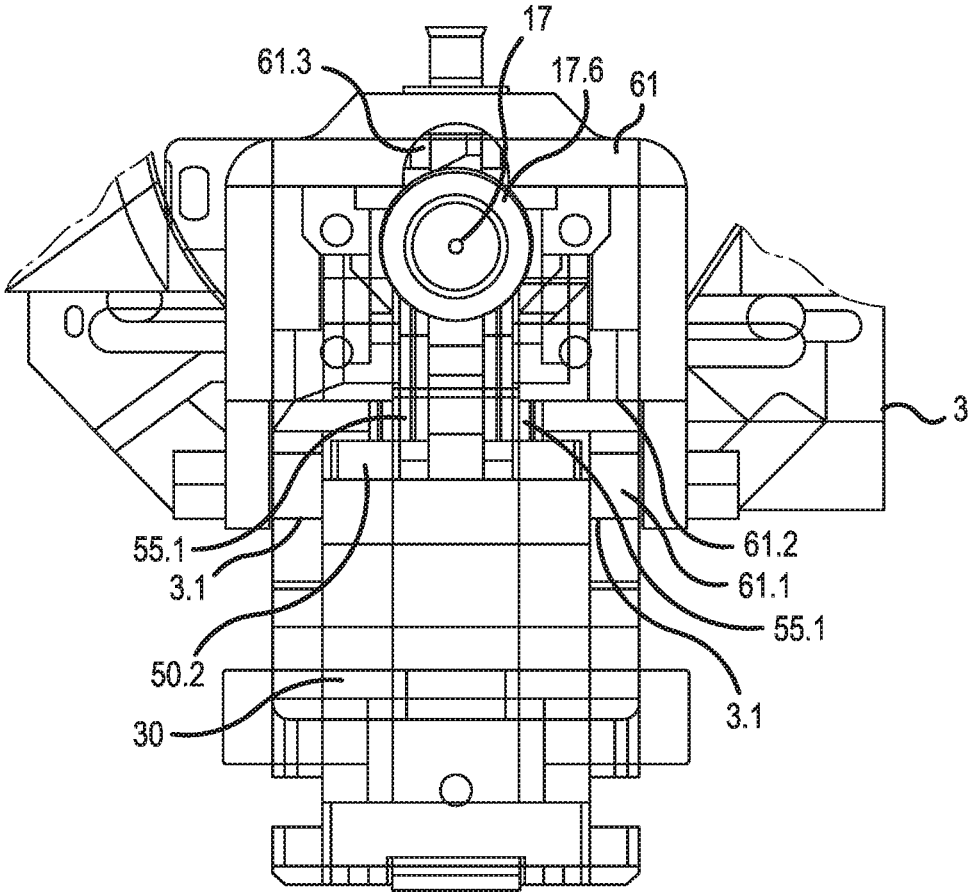
FIG. 14 shows an easily transparent representation of the weapon system with the breech and the weapon housing from the rear.

FIG. 14 shows in an easily transparent representation the extended connecting rod 61 for releasing the firing pin 17 in the direction of firing.

For the weapon 100 to be safely interrupted and brought into a state in which it is made safe, in particular in the event of a power failure, a magnet 71 is provided, interacting with a safety device 70. The safety device 70 is formed by a bolt 70.2 guided longitudinally on a rod 70.1. This bolt is guided forwardly and rearwardly with the breech 15 or breech head 15.1. In the event of a power failure, this magnet 71 drops out and presses onto the rod 70.1 by its spring. The rod 70.1 moves the bolt 70.2, which lies transversely in relation to the firing pin 17, into the breech 15, for example by tilting of the rod 70.1, so that the bolt 70.2 comes into engagement with a hole 17.7 in the firing pin 17. The firing pin 17 can in this way be secured in any position of the breech 15 within the weapon. This complies with the requirement for EOC safety (Electrical Operated Control). This EOC requirement stipulates that there must be a safety device on the last function of the weapon. The safety device can be used in the case of a weapon 100 as described above, with at least one weapon barrel 5, 5', 5", a weapon housing 3, a striking mechanism 16 incorporated in the weapon housing 3, a weapon cradle 2, and a weapon drive 1, with the slide 21 for transporting a breech 15 or breech head 15.1, which is moved by a breech drive 35, 36, 37.

As already explained, the striking mechanism described above is not restricted to use for falling-block breech actions 20. It may also be envisaged to use it for other kinds of breech action that are generally known, for instance also for toplever lock breech actions (DE 10 2005 045 824 B3, which is incorporated herein by reference). The striking mechanism can also be used independently of the kind of drive (DE 10 2009 011 939 A1, which is incorporated herein by reference; externally or self-powered) of the weapon 100 itself.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon comprising:

at least one weapon barrel;

a weapon housing;

a striking mechanism arranged in the weapon housing;

a weapon cradle;

a breech having a breech head;

a breech drive;

a securing device connected to a front end of the weapon cradle;

a holding-down device connected to a rear end of the weapon cradle; and a weapon drive with a slide for transporting the breech that is moveable by the breech drive, wherein at least the weapon housing and the weapon cradle are configured as modular main assemblies, wherein the striking mechanism is received by the weapon housing for which purpose the weapon housing has a receptacle for the striking mechanism, wherein the breech and the slide have lateral rails and guides which are mechanically connected to complementary rails and guides in the weapon housing by insertion and displacement, and wherein the weapon housing is inserted into the weapon cradle, the weapon housing being held down in the weapon cradle by the holding-down device at the rear end of the weapon cradle and by the securing device at the front end of the weapon cradle.

2. The weapon as claimed in claim 1, wherein the weapon drive is configured as a modular main assembly with the breech drive, the weapon drive being releasably connectable to the weapon cradle, and the breech drive of the weapon drive being functionally in connection with the slide on the weapon housing.

3. The weapon as claimed in claim 1, wherein the at least one weapon barrel is mounted in a weapon barrel cluster and the weapon barrel cluster is formed as a module which is carried by a barrel securing device of the weapon housing.

4. The weapon as claimed in claim 3, wherein the barrel securing device comprises at least two fixed steady rests, which have a swingable, removable or pivotable upper part.

5. The weapon as claimed in claim 3, wherein the weapon barrel cluster has in a partial region a control body, which peripherally has a control cam, with which the weapon barrel cluster is turnable about a common barrel cluster axis.

6. The weapon as claimed in claim 5, wherein a barrel changing drive is provided in a T-groove of the weapon cradle and mechanically secured therein by a pin.

7. The weapon as claimed in claim 1, further comprising a modular return damping device, which has two return dampers, which are provided in clearances in the weapon cradle and in cooperating clearances in the weapon housing.

8. The weapon as claimed in claim 1, wherein a carriage-mounting of the weapon takes place at bearing points of the weapon cradle.

9. The weapon as claimed in claim 1, wherein the weapon drive is an externally powered or self-powered drive.

10. The weapon as claimed in claim 1, wherein in a fully-assembled state of the weapon, the lateral rails and guides directly contact the complementary rails and guides.

11. The weapon as claimed in claim 1, wherein two free ends of the securing device have U-shaped receptacles that retain bolts of the weapon cradle, such that the securing device is pivotable about the bolts.

12. The weapon as claimed in claim 1, wherein the holding-down device is pivotally connected to the weapon cradle by a semi-circular shaped bolt.

13. The weapon as claimed in claim 1, wherein the striking mechanism includes a trigger rocker, a safety device, a striking hammer, a telescopic pushrod, and a spring mounted around the telescopic pushrod, wherein the trigger rocker acts on the safety device and the safety device interacts with the striking hammer, wherein the spring is tensioned when the breech is advanced and wherein a catching edge of the safety device engages under a catching edge of the striking hammer.

* * * * *